US006803545B2

(12) United States Patent
Blake et al.

(10) Patent No.: US 6,803,545 B2
(45) Date of Patent: Oct. 12, 2004

(54) ELECTRICALLY HEATED SMOKING SYSTEM AND METHODS FOR SUPPLYING ELECTRICAL POWER FROM A LITHIUM ION POWER SOURCE

(75) Inventors: Clinton E. Blake, Mechanicsville, VA (US); John R. Hairfield, Jr., Chester, VA (US); Charles T. Higgins, Richmond, VA (US); H. Neal Nunnally, Richmond, VA (US); Robert L. Ripley, Midlothian, VA (US)

(73) Assignee: Philip Morris Incorporated, Richmond, VA (US)

( * ) Notice: Subject to any disclaimer, the term of this patent is extended or adjusted under 35 U.S.C. 154(b) by 220 days.

(21) Appl. No.: 10/161,639

(22) Filed: Jun. 5, 2002

(65) Prior Publication Data

US 2003/0226837 A1 Dec. 11, 2003

(51) Int. Cl.[7] ..... H05B 3/58

(52) U.S. Cl. ..... 219/268; 219/535; 219/492; 131/194

(58) Field of Search ..... 219/268, 262, 219/263, 260, 269, 492, 535; 131/194, 195

(56) References Cited

U.S. PATENT DOCUMENTS

| | | | | |
|---|---|---|---|---|
| 5,028,500 A | | 7/1991 | Fong et al. | |
| 5,060,671 A | | 10/1991 | Counts et al. | |
| 5,144,962 A | * | 9/1992 | Counts et al. | 131/194 |
| 5,342,711 A | | 8/1994 | Tamura et al. | |
| 5,388,594 A | * | 2/1995 | Counts et al. | 131/329 |
| 5,498,855 A | * | 3/1996 | Deevi et al. | 219/553 |
| 5,499,636 A | | 3/1996 | Baggett et al. | |
| 5,505,214 A | | 4/1996 | Collins et al. | |
| 5,591,368 A | * | 1/1997 | Fleischhauer et al. | 219/535 |
| 5,665,262 A | * | 9/1997 | Hajaligol et al. | 219/553 |
| 5,934,289 A | | 8/1999 | Watkins et al. | |
| 5,981,107 A | | 11/1999 | Hamano et al. | |
| 6,040,560 A | * | 3/2000 | Fleischhauer et al. | 219/494 |
| 6,246,217 B1 | | 6/2001 | Yoshida et al. | |

FOREIGN PATENT DOCUMENTS

| | | | |
|---|---|---|---|
| JP | 2-100286 | * | 4/1990 |
| JP | 10-51962 A | | 2/1998 |
| JP | 10-285813 A | | 10/1998 |
| JP | 2002-240341 | * | 8/2002 |

OTHER PUBLICATIONS

PANASONIC, Overview of Lithium Ion Batteries, Jan. 2000, pp. 1–11.

PANASONIC, Battery Packs, Nickel Metal Hrdride Handbook, Jul. 2001, pp. 42–46.

TYCO/ Electronics, Raychem Circuit Protection, PolySwitch Resettable devices, Short–Form Catalog, Nov. 2001, pp. 1–12.

Notification of Transmittal of International Preliminary Examination Report dated Apr. 19, 2004 for PCT/US03/15997.

* cited by examiner

*Primary Examiner*—John A. Jeffery
(74) *Attorney, Agent, or Firm*—Burns, Doane, Swecker & Mathis, LLP

(57) ABSTRACT

An electrically heating smoking system wherein tobacco smoke is generated by heating a portion of a cigarette with an electrical resistance heating element powered by lithium ion battery cells. The lithium ion battery cells supply current to the electrical resistance heating element with current up to 20 times greater than the recommended discharge rate. To prevent damage to the lithium ion battery cells under such high discharge conditions, the smoking system includes a controller which provides modulated pulses of electrical power from the battery cells to the resistance heating element during smoking of the cigarette.

25 Claims, 4 Drawing Sheets

ELECTRICALLY HEATED SMOKING SYSTEM AND METHODS FOR SUPPLYING ELECTRICAL POWER FROM A LITHIUM ION POWER SOURCE

BACKGROUND OF THE INVENTION

1. Field of the Invention

The present invention relates to electrically heated smoking devices, and particularly to systems and methods for supplying electrical power to the electrically heated smoking devices from a lithium ion power source.

2. Description of Related Art

Lithium ion battery technology was introduced in the mid-nineteen nineties. Lithium ion batteries are rechargeable and do not exhibit memory effect which is common in other rechargeable batteries. Memory effect is a condition that occurs in some rechargeable batteries when the battery is not fully discharged before recharging. The battery remembers the amount of energy remaining in the battery at the time it was charged and will not discharge below that point. The result of the memory effect is that the energy storage capacity of the battery is reduced. Other significant advantages of lithium ion batteries are that they are lightweight, have a high energy storage capacity and higher voltage per cell than other batteries. This makes for a battery that is useful in small portable electronic equipment, e.g., wireless mobile telephones and notebook computers.

Due to the unique chemical structure and chemical reaction of lithium ion batteries, the batteries can be dangerous if over discharged or overcharged. Over discharging and overcharging of lithium ion batteries can cause an abundance of heat to be generated by the chemical reaction occurring in the battery. This abundance of heat can cause the lithium ion battery to become hot, catch fire or, explode. For this reason, circuitry is built into the lithium ion battery to monitor the temperature, voltage, and current drain of the battery. This circuitry will cut off power supplied by the lithium ion battery if the current drawn from the battery rises above a threshold level or the lithium ion battery voltage falls below a threshold level. The circuitry will also cut off power supplied to the lithium ion battery during charging if the voltage of the battery rises above a threshold level. Circuitry may also be included in the charger or a device connected to the battery to monitor charging and discharging of the lithium ion battery. This circuitry is required for each cell of a lithium ion battery adding to the cost of lithium ion batteries.

Lithium ion batteries are ideally suited for portable electronic equipment due to their small size and high energy densities. Portable electronic equipment generally draws relatively low current for sustained periods of time. Lithium ion batteries are not suitable for other portable equipment, e.g., cordless power tools, because these devices require a great amount of current when performing work, e.g., driving a screw with a cordless electric power drill. The required current would exceed the amount that lithium ion batteries can safely deliver creating a risk that the battery could become hot, catch fire, or explode.

The present invention provides an electrically heated smoking system which utilizes lithium ion batteries in a manner which allows high current to be delivered safely to the electrical resistance heating element during smoking of a cigarette.

BRIEF SUMMARY OF THE INVENTION

The invention provides an electrical heated smoking system having a heater including at least one electrical resistance heating element wherein a lithium ion power source is electrically connected to the at least one electrical resistance heating element and a controller controls a flow of modulated pulses of electrical power from the lithium ion power source to the at least one electrical resistance heating element to prevent damage to the lithium ion power source.

The invention also provides a method for supplying electrical power to at least one electrical resistance heating element from a lithium ion power source and controlling the electrical power provided to the at least one electrical heating element by sending modulated pulses of electrical power from the lithium ion power source to the at least one electrical heating element thereby preventing damage to the lithium ion power source.

BRIEF DESCRIPTION OF THE DRAWINGS

Various features of the invention will be described in the following detailed description in conjunction with the drawings, in which.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well known methods, devices, and circuits are omitted so as not to obscure the description of the present invention.

The present invention relates to an electrically heated smoking system. An exemplary electrically heated smoking system is disclosed in U.S. Pat. No. 6,040,560 issued to Fleischhauer et al which is hereby incorporated by reference. The disclosed electrically heated smoking system heats a portion of a cigarette with one or more electrical resistance heating element(s). A heated portion of the cigarette generates tobacco smoke that is delivered to the smoker when a smoker puffs on the cigarette. Electrical energy is supplied to the electrical resistance heating element from one or more nickel cadmium batteries. Nickel cadmium batteries have sufficient discharge capacity to deliver the large amount of current required by the electrical resistance heating element to rapidly heat a portion of a cigarette. Nickel cadmium batteries are also safe, rechargeable and relatively inexpensive.

While nickel cadmium batteries have been effective for use in electrically heated smoking systems, they are not without disadvantages. For example, nickel cadmium batteries suffer from memory effect. As discussed above, memory effect prevents a battery from fully discharging when the battery is not fully, or nearly fully, discharged prior to charging. This results in a decline in the storage capacity of the battery. When a nickel cadmium battery suffering from memory effect is used in an electrically heated smoking system, the battery requires more frequent recharging due to the reduced storage capacity. In addition, nickel cadmium batteries are relatively heavy, large and produce low voltage per cell.

Figure 1:
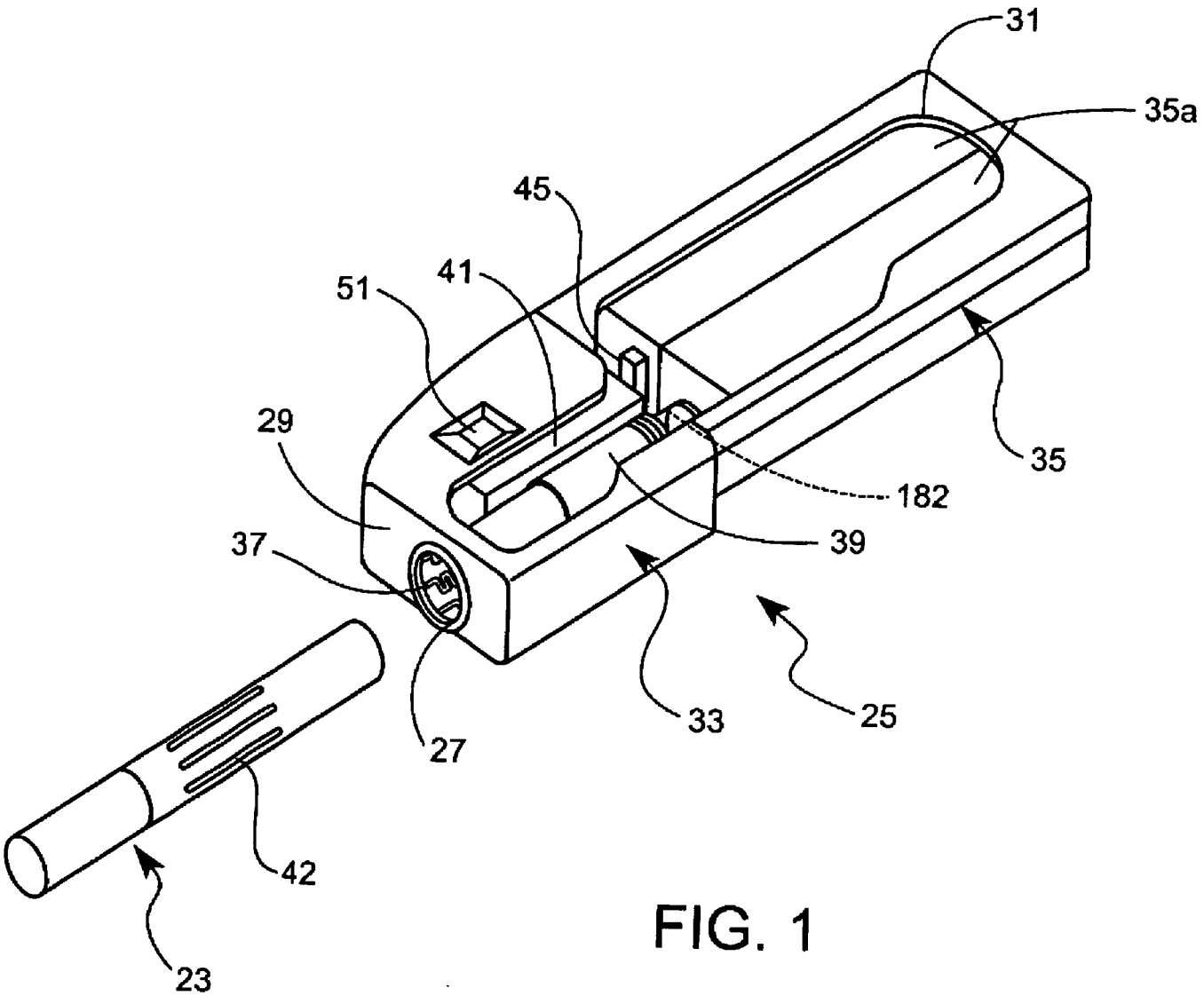
FIG. 1 is an isometric cut-away view of an electrically heated smoking device according to an embodiment of the invention.

Referring to FIG. 1, a preferred embodiment of the present invention provides a smoking system which preferably includes a cigarette 23 and a reusable lighter 25. The cigarette 23 is adapted to be inserted into and removed from a receptacle 27 at a front end portion 29 of the lighter 25. Once the cigarette 23 is inserted, the smoking system 21 is used in much the same fashion as a more traditional cigarette, but without lighting or smoldering of the cigarette 23. The cigarette 23 is discarded after one or more puff cycles. Preferably, each cigarette 23 provides a total of 8 puffs (puff cycles) or more per smoke; however, it is a matter of design expedient to adjust to a lesser or greater total number of available puffs.

The smoking system is described in greater detail in commonly assigned U.S. Pat. No. 5,388,594 which is hereby incorporated by reference in its entirety. The cigarette 23 is further described in commonly assigned U.S. Pat. No. 5,499,636, which is hereby incorporated by reference in its entirety.

The lighter 25 includes a housing 31 having front and rear housing portions 33 and 35. One or more batteries 35*a* are removably located within the rear housing portion 35 and supply energy to one or more electrical resistance heating element(s) 37 which are arranged within the front housing portion 33 adjacent the receptacle 27. A control circuit 41 in the front housing portion 33 establishes electrical communication between the batteries 35*a* and the electrical resistance heater elements 37. A preferred embodiment of the present invention includes details concerning the control circuit 41 and lithium ion power source 35*a* which are discussed in greater detail beginning with reference to FIG. 3.

Still referring to FIG. 1, preferably the rear portion 35 of the lighter housing 31 is adapted to be readily opened and closed, such as with screws or snap fit components, so as to facilitate replacement of the lithium ion power source 35*a*. An electrical socket or contacts may be provided for recharging the lithium ion power source 35*a* in a manner known to one skilled in the art.

The one or more batteries 35*a* are sized to provide sufficient power for the heaters 37 to function as intended and comprises a rechargeable lithium ion power source. The characteristics of the lithium ion power source are, however, selected in view of the characteristics of other components in the smoking system 21, particularly the characteristics of the heating elements 37. Commonly assigned U.S. Pat. No. 5,144,962, hereby incorporated by reference, describes a power arrangement which comprises a battery and a capacitor. The capacitor is recharged by the battery and power stored in the capacitor is used to supply electrical energy to the electrical resistance heating element.

Still referring to FIG. 1, preferably, the circuitry 41 is activated by a puff-actuated sensor 45 that is sensitive to either changes in pressure or changes in rate of airflow that occur upon initiation of draw on the cigarette 23 by a smoker. The puff-actuated sensor 45 is preferably located within the front housing portion 33 of the lighter 25 and is communicated with a space inside the heater fixture 39 adjacent the cigarette 23 through a passageway extending through a stop 182 located at the base of the heater fixture 39. A puff-actuated sensor 45 suitable for use in the smoking system 21 is described in commonly assigned U.S. Pat. No. 5,060,671 and commonly assigned U.S. Pat. No. 5,388,594, the disclosures of which are incorporated herein by reference.

An indicator 51 is provided at a location along the exterior of the lighter 25, preferably on the front housing portion 33, to indicate the number of puffs available in the cigarette 23. The indicator 51 preferably includes a seven segment liquid crystal display. In the preferred embodiment, the indicator 51 displays the digit "8" when a cigarette detector 53 detects the presence of a cigarette in the heater fixture 39. The detector 53 can comprise a light sensor adjacent the open end of the cigarette receptacle 27 that detects when a beam of light is reflected off (or alternatively, transmitted through) an inserted cigarette 23. Thereupon, the cigarette detector 53 provides a signal to the circuitry 41 which, in turn, responsively provides a signal to the indicator 51. The display of the digit "8" on the indicator 51 reflects that the eight puffs provided on each cigarette 23 are available, i.e., none of the heater elements 37 have been activated to heat the cigarette 23. After the cigarette 23 has been fully smoked, the indicator displays the digit "0". When the cigarette 23 is removed from the lighter 25, the cigarette detector 53 no longer detects the presence of a cigarette 23 and the indicator 51 is turned off. The cigarette detector 53 is modulated so that it does not constantly emit a beam of light, which would otherwise create an unnecessary drain on the lithium ion power source 35*a*. In an alternative to displaying the remainder of the puff count, the detector display may instead be arranged to indicate whether the system is active or inactive ("on" or "off").

As one of several possible alternatives to using the above-noted cigarette detector 53, a mechanical switch (not shown) may be provided to detect the presence or absence of a cigarette 23 and a reset button (not shown) may be provided for resetting the circuitry 41 when a new cigarette is inserted into the lighter, e.g., to cause the indicator 51 to display the digit "8", etc. Circuitry, puff-actuated sensors, and indicators useful with the smoking system 21 of the present invention are described in commonly assigned U.S. Pat. No. 5,060,671, U.S. Pat. No. 5,388,594 and the commonly assigned U.S. Pat. No. 5,505,214, all of which are incorporated by reference. Other alternatives for detecting the presence of a cigarette in the heater fixture 39 can include a metal detector that senses a metal foil or other metallic component within the cigarette.

In a preferred embodiment, the front housing portion 33 of the lighter 25 supports a substantially cylindrical heater fixture 39 which slidingly receives the cigarette 23. The heater fixture 39 houses the heater elements 37 and is adapted to support an inserted cigarette 23 in a fixed relation to the heater elements 37 such that the heater elements 37 are positioned at a desired location alongside the cigarette 23. The locations where each heater element 37 bears against (or is in thermal contact with) a fully inserted cigarette 23 is referred to herein as the heater footprint.

To assure consistent placement of the heating elements 37 relative to the cigarette 23 from cigarette to cigarette, the heater fixture 39 is provided with a stop 182 against which the cigarette is urged during its insertion into the lighter 25. Other expedients to registering the cigarette 23 relative to the lighter 25 could be used instead.

The front housing portion 33 of the lighter 25 also includes electrical control circuitry 41 which delivers a predetermined amount of energy from the lithium ion power source 35*a* to the electrical resistance heating elements 37. In the preferred embodiment, a heater fixture 39 includes eight circumferentially spaced-apart electrical resistance heating elements 37 which are concentrically aligned with the receptacle 27 so as to slidingly receive a cigarette 23. Details of the construction and establishment of electrical connections to the heater fixture 39 are illustrated and described in commonly assigned U.S. Pat. Nos. 5,388,594, 5,505,214, and 5,591,368, all of which are incorporated herein by reference in their entireties.

Figure 2:
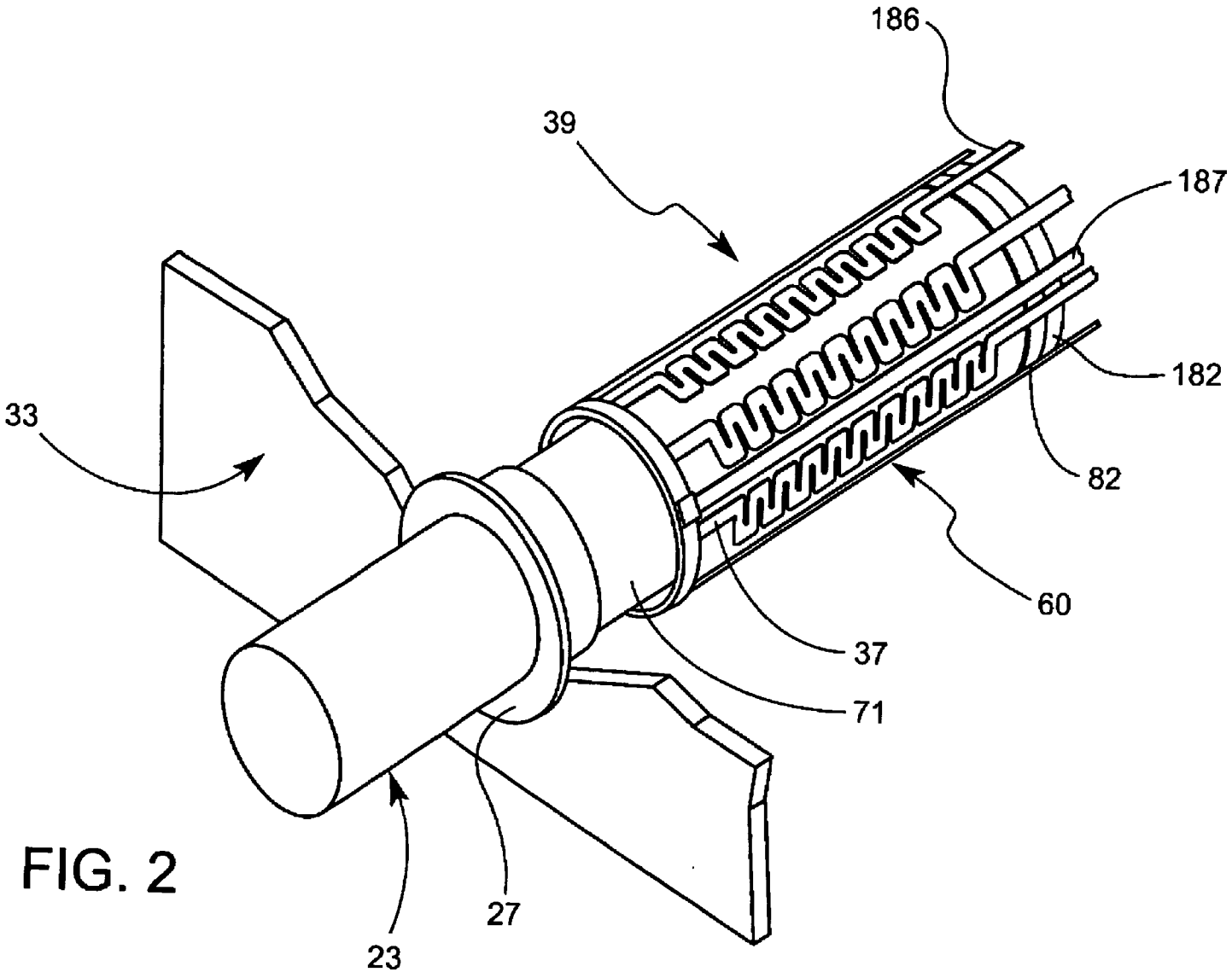
FIG. 2 is an isometric view of a plurality of electrical resistance heaters according to an embodiment of the invention.

Referring now to FIG. 2, a preferred heater fixture 39 includes "singular serpentine" elements 37, each of which is electrically connected at its opposite ends to a control circuit through leads 186 and 187. Details concerning this heater fixture 37 are set forth in commonly assigned U.S. Pat. No. 5,388,594, incorporated herein by reference in its entirety. Additional heater fixtures 37 that can be used as part of the lighter 25 include those disclosed in commonly assigned U.S. Pat. Nos. 5,665,262 and 5,498,855 which are incorporated herein by reference.

Preferably, the heaters 37 are individually energized by the lithium ion power source 35*a* under the control of the circuitry 41 to heat the cigarette 23 preferably eight times at spaced locations about a periphery of the cigarette 23. The heating renders eight puffs from the cigarette 23, as is commonly achieved with the smoking of more traditional cigarettes. It may be preferred to activate more than one heater simultaneously for one or more or all of the puffs.

A common phenomenon associated with batteries is a voltage reduction as the battery is discharged. This occurs because the battery's voltage potential decreases as the battery is discharged. As a result, a fully charged or "fresh" battery is capable of delivering more power than a battery that has been substantially discharged.

It has been found that the amount of power delivered to the electrical resistance heating element 37 and the lighter 25 affects the consistency of the smoke delivered to a smoker. It is desirable to deliver a consistent quality of smoke with each puff on the cigarette and from cigarette to cigarette. A fully charged or "fresh" battery will deliver more power to the electrical resistance heating element 37 in the lighter 25 producing a high amount of heat. Conversely, a substantially discharged battery will deliver less power to the electrical resistance heating element 37 in the lighter 25 producing less heat. Thus, the amount of heat delivered by the electrical resistance heater reduces as the battery becomes discharged. This difference in the amount of heat produced by the electrical resistance heater during the life of the battery affects the consistency of the smoke produced from the heating. Since it is desirable to produce a consistent quality of smoke from puff to puff and cigarette to cigarette, it is desirable to deliver the same amount of energy to the electrical resistance heater from puff to puff and cigarette to cigarette.

Commonly assigned U.S. Pat. No. 6,040,560 describes a system and method for delivering the same amount of energy to the electrical resistance heater between chargings of the battery, and is hereby incorporated by reference in its entirety. The same amount of energy is delivered to the heater from the battery using a control circuit that modulates the flow of electrical energy to the electrical resistance heating element. The control circuit determines the amount of modulation by measuring the voltage and/or current of the battery. Consumers generally puff on a cigarette for about two seconds. Thus, the heaters need to supply heat to the cigarette during at least a portion of the two seconds of the puff period. When a puff is detected, the controller sends modulated electrical power to the electrical resistance heater. In order to deliver the same amount of energy to the electrical resistance heater from puff to puff, the controller determines the off-time between the electrical pulses to send to the electrical resistance heater based on a measured voltage and/or current of the battery. A battery that is fully charged or "fresh" will have greater voltage potential than a weaker battery that has been partially or substantially discharged. As a result, a fully charged or "fresh" battery will require the controller to have longer off-times and send fewer pulses of electrical energy to the heater in order to deliver the same amount of energy. Conversely, a weaker battery that has been partially or substantially discharged will require the controller to deliver more pulses of electrical energy with shorter off-times to the heater in order to deliver the same amount of energy to the heater. By adjusting the number of electrical pulses delivered to the heater, and the off-times between the electrical pulses, the same amount of energy can be delivered to the heater from puff to puff for different charged states of the battery.

Figure 3:
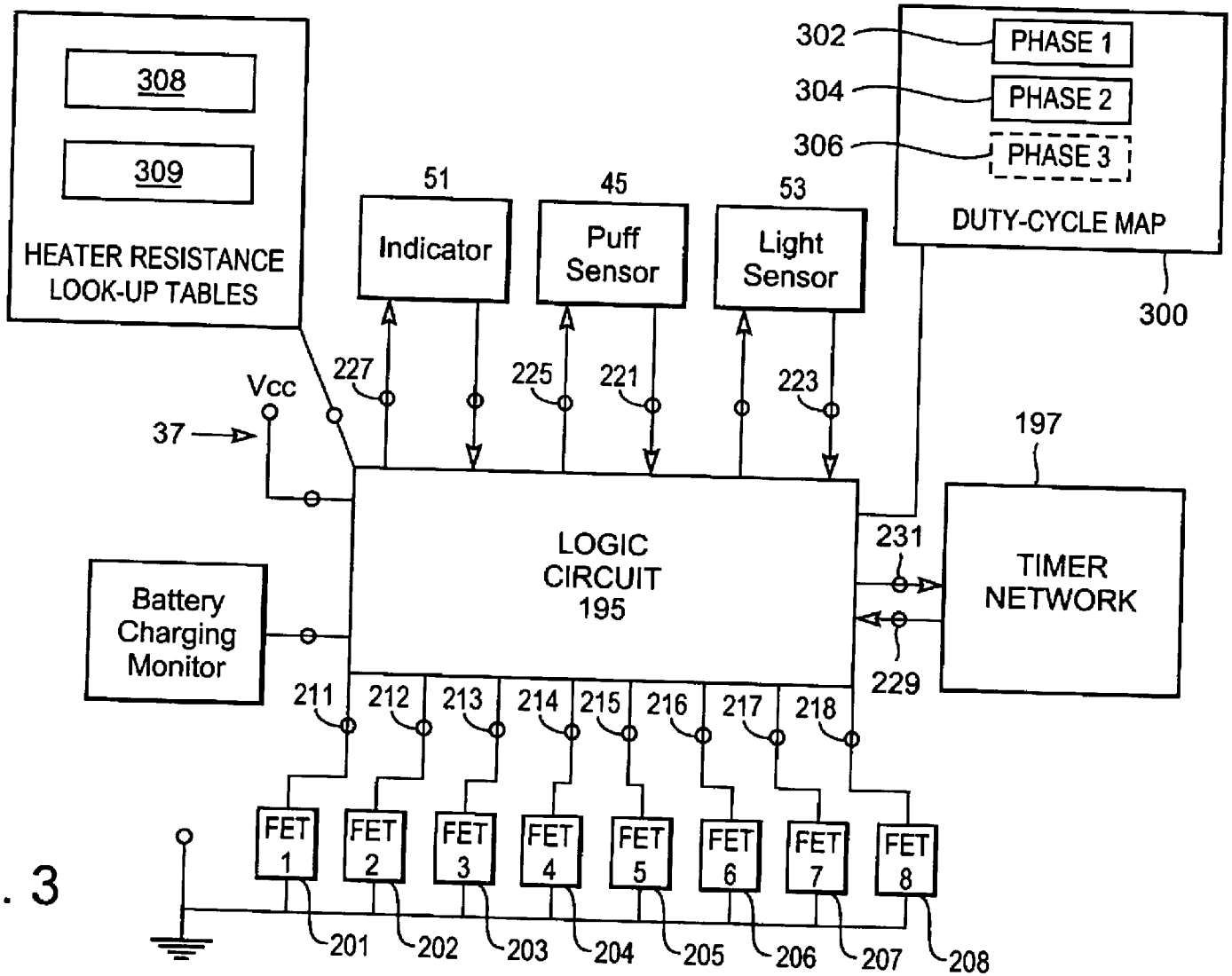
FIG. 3 is a schematic view of an electronic controller used in the electrically heated smoking device according to an embodiment of the invention.

FIG. 3 is a schematic diagram of an electrical circuit that can be used as the controller 41 in the lighter 25. Eight individual heater elements 43 (not shown in FIG. 2) are connected to a positive terminal of the power source 37 and to the negative terminal through corresponding field effect transistor (FET) heater switches 201 through 208. Individual (or selected) ones of the heater switches 201 through 208 will be turned on and off under the control of logic circuit 195 through terminals 211 through 218, respectively, during execution of a power cycle by the logic circuit 195. The logic circuit 195 provides signals for activating and deactivating particular ones of the heater switches 201 through 208 to activate and deactivate the corresponding ones of the heaters.

The logic circuit 195 cooperates with the timing circuit 197 to precisely execute the activation and deactivation of each heater element 37 in accordance with a predetermined total cycle period and to precisely divide each total cycle period into a predetermined number of phases, with each phase having its own predetermined period of time. In the preferred embodiment, the total cycle period has been selected to be 1.6 seconds (so as to be less than the two second duration normally associated with a smoker's draw upon a cigarette, plus provision for margin). The total cycle is divided preferably into two phases: a first phase having a predetermined time period of one second and a second phase having a predetermined time period of 0.6 seconds. As discussed above, modulated pulses of electrical energy are delivered to the heater to deliver a precise amount of energy to the heater from puff to puff for the life of the battery. Established within the control circuit 41 is a capacity to execute a power cycle that precisely duplicates a preferred thermal interaction (thermal-histogram) between the respective heater element 37 and adjacent portions of the cigarette 23. Additionally, once the preferred thermo-histogram is established, certain parameters (preferably, power cycles and off-times within each phase) are adjusted dynamically by the control circuit 41 so as to precisely duplicate the predetermined thermo-histogram with every power cycle throughout the range of voltages encompassed by the battery discharge cycle.

The puff-actuated sensor 45 supplies a signal to the electric circuit 195 that is indicative of smoker activation (i.e., a continuous drop in pressure of airflow over a sufficiently sustained period of time). The logic circuit 195 includes a routine for distinguishing between minor air pressure variations and more sustained draws on the cigarette to avoid inadvertent activation of heater elements in response to an errant signal from the puff-actuated sensor 45. The puff-actuated sensor 45 may include a piezo resistive pressure sensor or an optical flap sensor that is used to drive an operational amplifier, the output of which is in turn used to supply a logic signal to the logic circuit 195.

The light sensor 53 located adjacent the stop 182 supplies a signal to the logic circuit 195 that is indicative of insertion of a cigarette 23 in the lighter 25 to a proper depth (i.e., a cigarette is within several millimeters of the light sensor so as to be detected by a reflected light beam).

In order to conserve energy, it is preferred that the puff-actuated sensor 45 and the light sensor 53 be cycled on and off at low duty cycles (e.g., from about 2 to 10 percent of a duty cycle). For example, it is preferred that the puff actuation sensor 45 be turned on for a one millisecond duration for every ten milliseconds of the duty cycle. If, for example, the puff-actuated sensor 45 detects pressure drop or airflow indicative of draw on a cigarette during four consecutive pulses (i.e., over a 40 millisecond period), the puff-actuated sensor sends a signal through a terminal 221 to the logic circuit 195. The logic circuit 195 then sends a signal to an appropriate one of the terminals 211 through 218 to turn on an appropriate one of the FET heater switches 201 through 208.

Similarly, the light sensor 53 is preferably turned on for a one millisecond duration for every ten milliseconds. If, for example, the light sensor 53 detects four consecutive reflected pulses, indicating the presence of a cigarette 23 in the lighter 25, the light sensor sends a signal through terminal 223 to the logic circuit 195. The logic circuit 195 then sends a signal through terminal 225 to the puff-actuated sensor 45 to turn on the puff-actuated sensor. The logic circuit 195 also sends a signal through terminal 227 to the indicator 51 to turn it on. The above-noted modulation techniques reduce the time average current required by the puff-actuation sensor 45 and the light sensor 53, and thus extend the life of the lithium ion power source 37.

The electric circuit 195 can include a PROM (programmable read-only memory) 300, which may include preferably at least two databases or look-up tables 302 and 304 and optionally, a third database (look-up table) 306. Each of the look-up tables 302, 304 (and optionally 306) converts a signal indicative of battery voltage to a signal indicative of the power cycle (for the first phase and for the second phase) to be used in execution of the respective phases of the power cycle.

Upon initiation of a power cycle, the logic circuit receives a signal indicative of lithium ion power source voltage and/or current, and then references the voltage and/or current reading to the first look-up table 302 to establish a duty cycle for the initiation of the first phase of the power cycle. The first phase is continued until the timing network 197 provides a signal indicating that the predetermined time period for the first phase has elapsed, whereupon the logic circuit 195 references the lithium ion power source voltage and/or current in the second look-up table 304 and establishes a duty cycle for the initiation for the second phase. The second phase is continued until the timing network 197 provides a signal indicating that the predetermined time period for the second phase has elapsed, whereupon the timing network 197 provides a shut-off signal to the logic circuit 195 at the terminal 229. Optionally, the logic circuit 195 could initiate a third phase and establish a third duty cycle, and a shut-off signal would not be generated until the predetermined period of time for the third phase has elapsed. The present invention could be practiced with additional phases or other variations of the power cycle.

Although the present invention can be practiced by using the look-up tables during an initial portion of each phase to establish a duty cycle to be applied throughout the substantial entirety of each phase, the preferred practice is to have the logic circuit 195 configured to continuously reference the lithium ion power source voltage and/or current together with the respective look-up tables 302, 303 and 306 so as to dynamically adjust the value set for the duty cycle in response to fluctuations in lithium ion power source voltage as the control circuit progresses through each phase. Such practice can provide a more precise repetition of the desired thermo-histogram.

The timing network 197 is also preferably adapted to prevent actuation of one heater element 43 to the next as the lithium ion power source discharges. Other timing network circuit configurations may also be used, such as those described in commonly assigned U.S. Pat. No. 5,505,214, the disclosure of which is incorporated herein by reference.

In an exemplary embodiment of smoking a cigarette, a cigarette 23 is inserted in the lighter 25 and the presence of the cigarette is detected by a sensor such as a metal detector effective for sensing the presence of a metal foil in the cigarette, or the light sensor 53. Light sensor 53 sends a signal to the logic circuit 195 through terminal 223. The logic circuit 195 ascertains whether the lithium ion power source 37 is charged or whether the immediate voltage is below an acceptable minimum. If, after insertion of the cigarette 23 in the lighter 25, the logic circuit 195 detects that the voltage of the lithium ion power source is too low, the indicator 51 blinks and further operation of the lighter will be disabled until the lithium ion power source is recharged. Voltage of the lithium ion power source 37 is also monitored during activation of the heater elements 37 and the activation of a heating element is interrupted if the voltage drops below a predetermined value.

When the logic circuit 195 receives a signal through terminal 221 from the puff-actuated sensor 45 that a sustained pressure drop or airflow has been detected, the logic circuit locks out the light sensor 53 during puffing to conserve power. The logic circuit 195 sends a signal through terminal 231 to the timer network 197 to activate the timer network, which then begins to function phase by phase in the manner previously described. The logic circuit 195 also determines, by a down count routine, which one of the eight heater elements is due to be heated and sends a signal through an appropriate terminal 211 through 218 to turn on an appropriate one of the FET heater switches 201 through 208. The appropriate heater stays on while the timer runs.

When the timer network 197 sends a signal through terminal 229 to the logic circuit 195 indicating that the timer has timed out, the particular FET heater switch 211 through 218 is turned off, thereby cutting off power to the heating element. The logic circuit 195 also down counts and sends a signal to the indicator 51 through terminal 227 so that the indicator will display that one less puff is remaining (i.e., "7", after the first puff). When the smoker next puffs on the cigarette 23, the logic circuit 195 will turn on another one of the predetermined FET heater switches 211 through 218, thereby supplying power to another predetermined one of the heater elements. The process will be repeated until the indicator 51 displays "0", meaning that there are no more puffs remaining on the cigarette 23. When the cigarette 23 is removed from the lighter 25, the light sensor 53 indicates that the cigarette is not present, and the logic circuit 195 is reset.

Other features, such as those described in U.S. Pat. No. 5,505,214, which is incorporated by reference, may be incorporated in the control circuit 41 instead of, or in addition to, the features described above. For example, if desired, various disabling features may be provided. One type of disabling feature includes timing circuitry (not shown) to prevent successive puffs from occurring too close together, so that the lithium ion power source 35*a* has time to recover. Another disabling feature includes means for disabling the lighter 25 if an unauthorized product is inserted in the heater fixture 39. For example, the cigarette 23 might be provided with an identifying characteristic that the lighter 25 must recognize before the heating elements 37 are energized.

The lithium ion power source 35*a* is preferably one or more lithium ion batteries. Manufacturers of lithium ion batteries recommend that the batteries not be discharged at greater than 1 C wherein "C" is the numerical equivalent to the discharge capacity of the battery in milliamps (mA). Thus, for a 1000 mAh battery, the battery should not be discharged at a current greater than 1000 milliamps (mA) or 1 amp. This is because discharging the battery at rates greater than 1 C could cause the battery to become hot, catch fire, or explode. The electrical resistance heaters of the present invention draw peak discharge currents in the range of 15 to 30 C. This is well above industry norms of discharge rates of between 2 to 3 C for consumer products that are considered to require high discharge rates. Although lithium ion batteries are not intended to deliver the discharge rates required for electrical smoking systems, the electrically heated smoking device of the present invention provides an arrangement wherein lithium ion batteries can be used safely and effectively.

Lithium ion batteries have higher voltages, typically, a usable range of between 4.2 and 3.0 volts, than other rechargeable batteries, meaning that a single lithium ion battery cell has a voltage roughly equivalent to three nickel cadmium batteries connected in series. The smoking system according to the invention is operated such that the electrical resistance heaters become hot in a very short period of time after a smoker begins puffing on the cigarette. For this near instantaneous heating to occur, a voltage of between 3 and 20, preferably 3 and 12, volts is required. Since lithium ion batteries have higher voltages than other rechargeable batteries, fewer lithium ion cells are required to meet the required range of voltages.

Even though the electric resistance heaters of the smoking system draw current of as much as 30 C which is far in excess of the 1 CmA recommended by lithium ion battery manufacturers, lithium ion batteries have proven to be effective to supply power to the electric resistance heater. This is because the required current is drawn from the lithium ion battery for a short period of time on the order of approximately one to two seconds, preferably 1.6 seconds, which is too short of a duration to cause the battery to lose so much voltage that it can no longer generate sufficient power for good flavor generation, or become hot, catch fire or explode.

Manufacturers of lithium ion batteries provide circuitry within the battery to prevent overdischarge and overcharging of the lithium ion battery. Since the electric resistance heaters of the smoking system draw current that is as much as 20 times, or more, than the manufacturer's recommended discharge rate, typically 1 C, the manufacturer's over discharge protection circuitry would be triggered when used with the electric resistance heaters of the smoking system. In order to use the lithium ion batteries with the electrical resistance heaters of the smoking system, the parameters of the over discharge protection circuitry are preferably adjusted upward.

Figure 4:
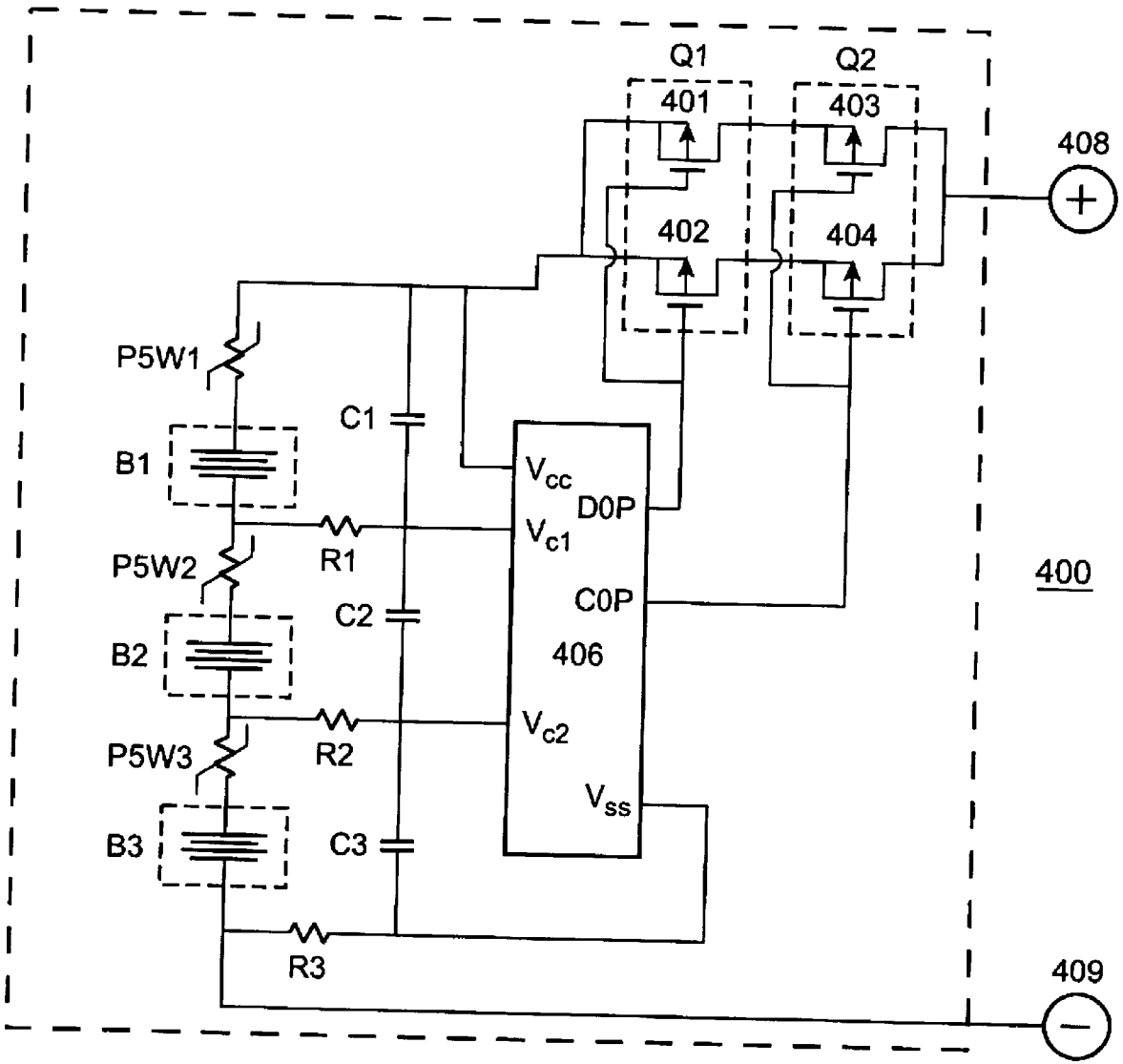
FIG. 4 is a schematic view of a control circuit and lithium ion power source used in the electrically heated smoking device according to an embodiment of the invention.

FIG. 4 illustrates an exemplary lithium ion battery and protection circuit usable in the present invention. As illustrated, the battery pack 400 includes three lithium ion battery cells B1–B3 connected in series and circuitry to prevent the battery from overdischarging and overcharging to thereby avoid conditions may cause the battery to get hot, catch fire, or explode.

The lithium ion battery cells can have an electrical storage capacity of between 100 and 2000 mAh, preferably between 200 and 1500 mAh, and more preferably between 250 and 1000 mAh. Current discharge from each of the lithium ion batteries cells B1–B3 flows through a respective polyswitch PSW1–PSW3. The polyswitches PSW1–PSW3 can be, for example, model number LR4-450 available from the Raychem Circuit Protection Division of the Tyco Electronics Corporation located in Menlo Park, Calif. The polyswitches PSW1–PSW3 cut off current flow when the current flowing through the polyswitch rises above a predetermined threshold level, e.g., greater than 50 C, preferably greater than 30 C, and more preferably greater than 20 C. Unlike a fuse, the polyswitches will reconnect current flow after a period of time has elapsed. Polyswitches also provide the advantage of sensing temperatures and shutting off if temperatures reach too high a level. Each of the lithium ion battery cells can be connected to a respective series RC circuit having a resistor R1–R3 and a capacitor C1–C3. The RC circuits isolate the respective lithium ion battery cell from the rest of the circuit in the battery pack 400.

An Application Specific Integrated Circuit (ASIC) 406 (or preprogrammed microcontroller or microprocessor) can be used to monitor the voltage of each of the lithium ion battery cells B1–B3. A signal indicative of the voltage of the first lithium ion battery cell B1 is supplied to the ASIC 406 via terminal $V_{C1}$. A signal indicative of the voltage of the second lithium ion battery cell B2 is supplied to terminal $V_{C2}$. A signal indicative of the voltage of the third lithium ion battery cell B3 is supplied to terminal $V_{SS}$ of ASIC 406. Power is supplied to the ASIC 406 via terminal $V_{CC}$. Switches Q1 and Q2 are activated by the ASIC 406 via terminals DOP and COP. Switch Q1 includes a pair of field effect transistors (FET) 401 and 402. Similarly switch Q2 also includes a pair of field effect transistors (FET) 403 and 404. The pair of field effect transistors used in each switch Q1 and Q2 permits the requisite amount of current to flow through switch Q1 or Q2 to the electrical resistance heating element without damaging the field effect transistors. When the ASIC 406 detects a discharge voltage below a predetermined threshold limit, e.g., 2.3 volts, the ASIC 406, via terminal DOP, cuts off power supplied to the gates of field effect transistors 401 and 402 of switch Q1 to stop current from flowing from the battery 400. When the ASIC 406 detects that the voltage of the lithium ion battery cells is above a predetermined threshold level, e.g., 4.3 volts, the ASIC 406, via terminal COP, cuts off the supply of power to the gates of field effect transistors 403 and 404 of switch Q2 disconnecting flow of current into the battery pack 400.

Thus, in the exemplary embodiment the current flow capacity of the polyswitches has been increased to a level sufficient to supply the greater current flow required by the electrical resistance heating element. In addition, switches Q1 and Q2 include two FETs so that the requisite current required by the electrical resistance heating elements can flow through switches Q1 and Q2 without damaging the FETs.

While an exemplary battery pack 400 of the present invention has been described, it will be apparent to one skilled in the art to use any desired number of lithium ion batteries, e.g., one or more lithium ion battery cells, or alternative arrangements of electrical circuitry for protecting a lithium ion battery cell. It will also be appreciated by those skilled in the art that switches Q1 and Q2 could be made from any electrically controllable switches, e.g., relays. Thus, any combination of lithium ion battery cells and electrical circuitry are considered to be within the scope of the present invention.

The invention has been described with reference to a particular embodiment. However, it will be readily apparent to those skilled in the art that it is possible to embody the invention in specific forms other than those of the preferred embodiments described herein. This may be done without departing from the spirit of the invention. The preferred embodiments are merely illustrative and should not be considered restrictive in any way. The scope of the invention is given by the appended claims, rather than the preceding description, and all variations and equivalents which fall within the range of the claims are intended to be embraced therein.

What is claimed is:

1. An electrically heated smoking system comprising:

at least one electrical resistance heating element;

a lithium ion power source electrically connected to the at least one electrical resistance heating element; and a controller to control a flow of modulated pulses of electrical power from the lithium ion power source to the at least one electrical resistance heating element to prevent damage to the lithium ion power source.

2. The electrically heated smoking system of claim 1, wherein the lithium ion power source comprises a lithium ion battery cell.

3. The electrically heated smoking system of claim 2, wherein the lithium ion battery cell has a maximum voltage greater than 4 volts.

4. The electrically heated smoking system of claim 2, wherein the lithium ion battery cell has a discharge capacity of 250 to 2000 mAh.

5. The electrically heated smoking system of claim 2, wherein the lithium ion battery cell has a peak discharge current of 15 to 30 times an ampere hour capacity of the lithium ion battery cell.

6. The electrically heated smoking system of claim 2, wherein the lithium ion battery cell has an average discharge current of 10 to 20 times an ampere hour capacity of the lithium ion battery cell.

7. The electrically heated smoking system of claim 2, wherein the lithium ion power source comprises at least one lithium ion battery cell and circuitry to stop flow of current if the at least one lithium ion battery cell is short circuited.

8. The electrically heated smoking system of claim 7, wherein the lithium ion power source comprises multiple lithium ion battery cells.

9. The electrically heated smoking system of claim 8, wherein the lithium ion power source comprises three lithium ion battery cells.

10. The electrically heated smoking system of claim 8, wherein the multiple lithium ion battery cells are electrically connected together in series such that the multiple lithium ion battery cells deliver a voltage to the at least one electrical heating element that is equal to a sum of a voltage of each of the lithium ion battery cells.

11. The electrically heated smoking system of claim 8, wherein each of the multiple lithium ion battery cells has a maximum voltage greater than 4 volts.

12. The electrically heated smoking system of claim 8, wherein each of the multiple lithium ion battery cells has a discharge capacity of 250 to 2000 mAh.

13. The electrically heated smoking system of claim 8, wherein each of the multiple lithium ion battery cells has a peak discharge current of 15 to 30 times an ampere hour capacity of each of the lithium ion battery cells.

14. The electrically heated smoking system of claim 8, wherein each of the multiple lithium ion battery cells has an average discharge current of 10 to 20 times an ampere hour capacity of each of the lithium ion battery cells.

15. The electrically heated smoking system of claim 7, wherein the circuitry monitors charging of the at least one lithium ion battery cell to prevent over heating and over charging of the at least one lithium ion battery cell.

16. The electrically heated smoking system of claim 1, wherein the at least one electrical resistance heating element comprises a plurality of electrical resistance heating elements each of which is disposed proximate to the cigarette and individually activated to heat a selected portion of the cigarette.

17. A method for smoking a cigarette with an electrically heated smoking system, the method comprising:

providing electrical power to at least one electrical heating element from a lithium ion power source, the at least one electrical heating element being arranged to heat at least a portion of a cigarette sufficiently to generate tobacco smoke; and controlling the electrical power provided to the at least one electrical heating element by sending modulated pulses of electrical power from the lithium ion power source to the at least one electrical heating element thereby preventing damage to the lithium ion power source.

18. The method of claim 17, wherein the lithium ion power source comprises at least one lithium ion battery cell which supplies electrical current to the at least one electrical heating element.

19. The method of claim 18, wherein the lithium ion battery cell has a discharge capacity of 250 to 2000 mAh which supplies electrical current to the at least one electrical heating element.

20. The method of claim 18, wherein the lithium ion battery cell has an average discharge current of 10 to 20 times an ampere hour storage capacity of the lithium ion battery cell which supplies electrical current to the at least one electrical heating element.

21. The method of claim 18, wherein the lithium ion battery cell delivers a peak current of 15 to 30 times an ampere hour storage capacity of the lithium ion battery cell to the at least one electrical heating element which supplies electrical current to the at least one electrical heating element.

22. The method of claim 18, wherein the lithium ion battery cell has a maximum voltage greater than 4 volts.

23. The method of claim 18, wherein the lithium ion battery cell has a discharge capacity of 250 to 2000 mAh.

24. The method of claim 17, wherein the at least one electrical resistance heating element comprises a plurality of electrical resistance heating elements each of which is disposed proximate to the cigarette to heat selected portions of the cigarette.

25. The method of claim 17, wherein the lithium ion power source includes at least one lithium ion battery cell and circuitry to stop flow of current if the at least one lithium ion battery cell is short circuited.

* * * * *